US008739354B2

(12) United States Patent
Buckner

(10) Patent No.: US 8,739,354 B2
(45) Date of Patent: Jun. 3, 2014

(54) MOBILE METHOD FOR SERVICING OR CLEANING A UTILITY SEWER OR DRAINAGE PIPE

(76) Inventor: Lynn A. Buckner, Chickamauga, GA (US)

( * ) Notice: Subject to any disclaimer, the term of this patent is extended or adjusted under 35 U.S.C. 154(b) by 552 days.

(21) Appl. No.: 12/807,119

(22) Filed: Aug. 27, 2010

(65) Prior Publication Data

US 2010/0326481 A1 Dec. 30, 2010

Related U.S. Application Data

(63) Continuation-in-part of application No. 11/809,957, filed on Jun. 4, 2007, now abandoned, which is a continuation-in-part of application No. 11/208,565, filed on Aug. 22, 2005, now Pat. No. 7,644,523, which is a continuation-in-part of application No. 10/217,055, filed on Aug. 12, 2002, now Pat. No. 6,988,568.

(60) Provisional application No. 61/275,411, filed on Aug. 28, 2009, provisional application No. 61/277,201, filed on Sep. 22, 2009, provisional application No. 60/810,747, filed on Jun. 5, 2006, provisional application No. 60/814,791, filed on Jun. 20, 2006, provisional application No. 60/814,721, filed on Jun. 20, 2006, provisional application No. 60/363,058, filed on Mar. 11, 2002, provisional application No. 60/384,719, filed on Jun. 3, 2002.

(51) Int. Cl.
*B08B 3/02* (2006.01)
*B08B 9/04* (2006.01)

(52) U.S. Cl.
USPC ..... 15/302; 134/168 C; 15/315; 15/340.1; 15/104.31

(58) Field of Classification Search
USPC ..... 15/302, 321, 340.1, 339, 315, 320, 353, 15/104.31; 134/166 R, 167 R, 168 C, 167 C, 134/169 C, 166 C, 168 R, 169 R, 171; 210/170.01, 241; 212/223, 235, 212/245–248, 253; 137/355.12, 355.19, 137/355.26, 355.27; D32/14; 348/82, 84
See application file for complete search history.

(56) References Cited

U.S. PATENT DOCUMENTS 446,745 A * 2/1891 Schenck ..... 137/355.26
2,057,842 A * 10/1936 Nielsen ..... 15/104.09

(Continued)

FOREIGN PATENT DOCUMENTS

DE 4223931 A1 * 1/1994 ..... B08B 9/02
EP 387758 A2 * 9/1990 ..... E03F 7/10

(Continued)

OTHER PUBLICATIONS

JP10095573A (Abstract), 1998.*

(Continued)

*Primary Examiner* — Mark Spisich
*Assistant Examiner* — Andrew A Horton

(57) ABSTRACT

The present invention relates to a compact user friendly multi tool mobile sewer jetting and in ground utility servicing vehicle with one or more reels mounted on an articulated boom which is pivotably mounted to a service vehicle via a slewing ring gear. A vacuum excavation system with a vacuum hose and vacuum hose reel may also be mounted on the mobile vehicle. The articulated boom having a first end pivotably mounted to a mobile vehicle via a slewing ring gear. The articulated boom may have sufficient strength to support a jetter hose reel mounted near a second end of the boom and the boom may have sufficient move ability to position and stabilize the reel near a man hole or service work area for user friendly use by an operator. Sensors, monitors and controllers are included to gather data related to the operation of the service vehicle.

19 Claims, 14 Drawing Sheets

(56) References Cited

U.S. PATENT DOCUMENTS

| | | | | | |
|---|---|---|---|---|---|
| 3,658,589 | A * | 4/1972 | Shaddock | 134/10 |
| 4,199,837 | A * | 4/1980 | Fisco, Jr. | 15/302 |
| 4,446,591 | A * | 5/1984 | Wiedemann | 15/315 |
| 4,622,709 | A * | 11/1986 | Matsuda | 15/4 |
| 4,661,848 | A * | 4/1987 | Matsuda | 348/84 |
| 4,773,113 | A * | 9/1988 | Russell | 15/4 |
| 5,203,646 | A * | 4/1993 | Landsberger et al. | 405/191 |
| RE34,585 | E * | 4/1994 | Schmidt et al. | 134/167 C |
| 5,408,766 | A * | 4/1995 | Pobihushchy | 37/323 |
| 5,622,571 | A * | 4/1997 | Derlein | 134/22.11 |
| 5,636,648 | A * | 6/1997 | O'Brien et al. | 134/107 |
| 6,378,627 | B1 * | 4/2002 | Tubel et al. | 175/24 |
| 6,454,212 | B1 * | 9/2002 | Bartov | 244/135 A |
| 6,686,950 | B1 * | 2/2004 | Caffon et al. | 348/83 |
| 2002/0152576 | A1 * | 10/2002 | Murray et al. | 15/319 |
| 2003/0140946 | A1 * | 7/2003 | Coats | 134/18 |
| 2004/0020270 | A1 * | 2/2004 | Kuikka | 73/49.5 |

FOREIGN PATENT DOCUMENTS

| | | | | |
|---|---|---|---|---|
| JP | 08257522 | A * | 10/1996 | B08B 9/02 |
| JP | 10095573 | A * | 4/1998 | B08B 9/02 |

OTHER PUBLICATIONS

EP387758A2 (Abstract), 1990.*

* cited by examiner

Side View
76
209
8
12
31 Mobile Vehicle
38 DRAIN PIPE
45 DEBRIS
301
302
303
2
39
18
5
300
304
305
306
307
201
202
306
204
203
200
Vacuum Hose
Boom
208
205A
303
208
37 Hose Reel
58 Jetter Hose
209
34
312
313
315
206 TELESCOPING
BOOM ARM
205
206A
17
313T
RFID Tag
59
45 DEBRIS
Graphic
Display
312
209
Flash
Drive
Digital
Display
34
313R Top View Top View Top View

Fig. 5 Top View

Top View

SIDE View

SIDE View

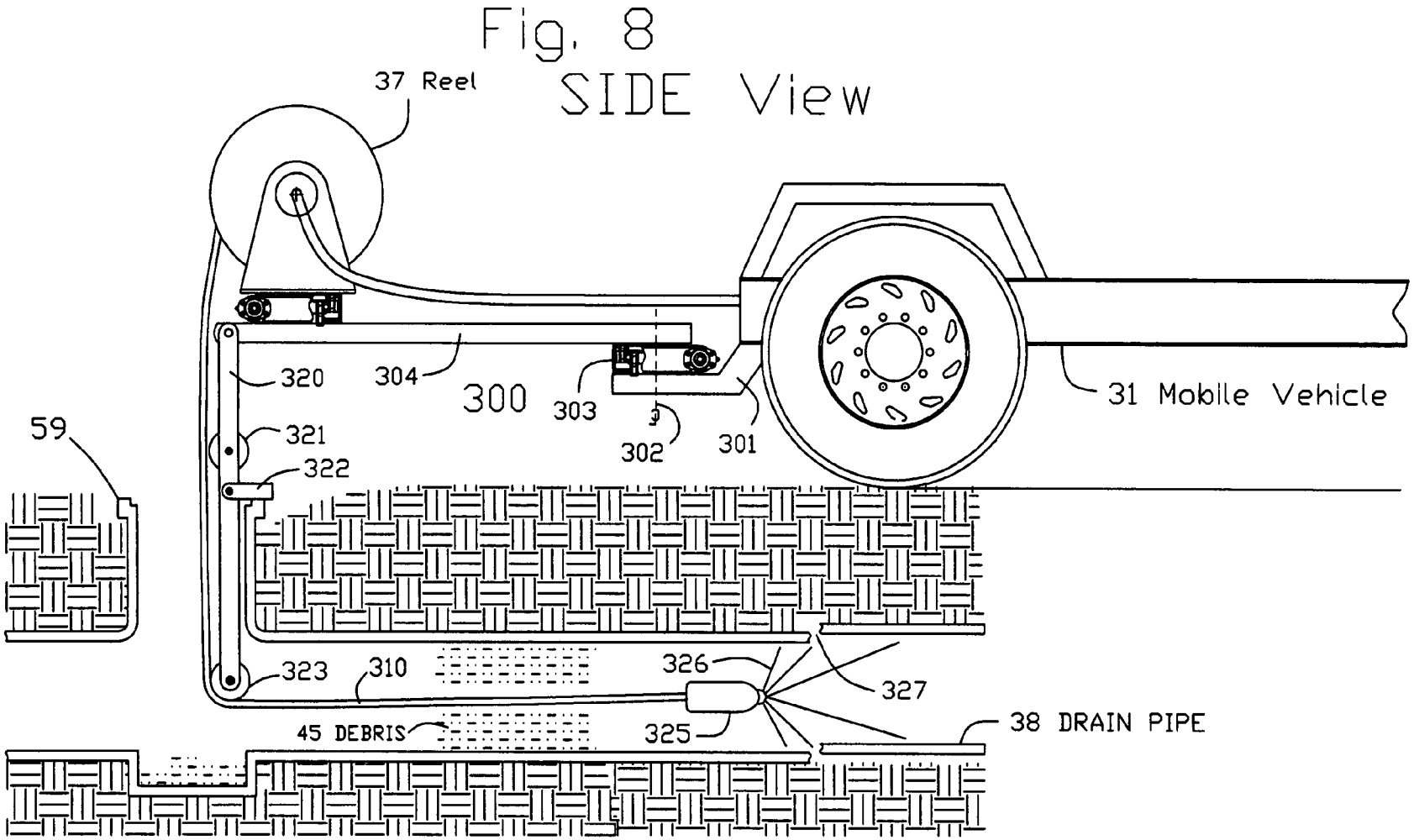
Fig. 8 SIDE View

SIDE View

Side View

End View

Side View

End View

MOBILE METHOD FOR SERVICING OR CLEANING A UTILITY SEWER OR DRAINAGE PIPE

This application claims the benefits of provisional application No. 61/275,411 filed 28 Aug. 2009; and claims the benefit of provisional application No. 61/277,201 filed 22 Sep. 2009; and claims the benefits of provisional application No. 60/810,747 filed Jun. 5, 2006; and claims the benefits of provisional application No. 60/814,791 filed Jun. 20, 2006; and claims the benefits of provisional application No. 60/814,721 filed Jun. 20, 2006. This application is a CIP of Non-Provisional application Ser. No. 11/809,957 filed 4 Jun. 2007 now abandoned which is a CIP of parent application Ser. No. 11/208,565 filed Aug. 22, 2005 now U.S. Pat. No. 7,644,523. Said Non-Provisional application Ser. No. 11/208,565 filed Aug. 22, 2005 is a CIP of it's Parent application Ser. No. 10/217,055 filed 12 Aug. 2002 now U.S. Pat. No. 6,988,568 to include it's 24 Sep. 2002 & 12 Mar. 2003 amendment and U.S. Provisional Application No. 60/363,058 filed on 11 Mar. 2002 and U.S. Provisional Application No. 60/384,719 filed on 3 Jun. 2002.

BACKGROUND OF THE INVENTION

1. Field of the Invention

The present invention relates to a mobile vehicle for servicing in ground utilities. And more particularly a mobile vehicle having a hose reel mounted on an articulated boom arm. And more particularly a mobile vacuum excavation vehicle having a hose reel mounted on an articulated boom arm, wherein a first end of the boom is mounted on the mobile vehicle and a hose reel is mounted near a second end of the boom. Sensors, monitors, controllers and computers are used in the operation.

An example of the invention being a jetter hose reel mounted on the second end of a boom and the boom being pivotably mounted on a skid, trailer or truck. The boom may have sufficient strength to support the hose reel and the boom may have sufficient move ability to position and secure the jetter hose reel near a man hole. The articulation of the boom may be powered by means such as electricity or hydraulics. The boom may be secured in a position by means such as a mechanical brake, hydraulics valve, gearing, electric brake or a pin.

2. Description of the Prior Art

The use of hose reels mounted on a vehicle is known in the prior art. Hose reels are relatively heavy in weight and are generally mounted rigidly to the vehicle. Hose reels are known to have a lazy Susan base placed between them and the ridged vehicle mount. It is also known in the art to have a drawer type, in or out slide on a truck to attach the hose reel. U.S. Pat. No. 5,636,648 and U.S. Pat. No. 4,896,686 disclose a hose reel mounted on a drawer slide with a lazy Susan mount for the hose reel to attach.

While these devices fulfill their respective, particular objectives and requirements, the need remains for a method that can support the weight of a hose reel and simultaneously articulate the hose reel into a user friendly position near a man hole or other work station or utility.

SUMMARY OF THE INVENTION

The shortcomings and disadvantages of the prior art are overcome by the mobile vehicle mounted, articulated boom and reel arrangement of the current invention.

It is an object of the present invention to provide a mobile vehicle having an engine; a vacuum system comprising a vacuum container, a blower to produce a vacuum environment within the vacuum container and a vacuum hose to vacuum solids or liquid into the vacuum container; jetter system comprising a water storage container, a water pump which is a means for pressurizing water, a jetter hose which is a water conduit for transporting pressurized water from the pump to a jetter nozzle, a reel to wind the jetter hose on and a pivot ably mounted articulated boom to support the jetter hose reel. The articulated boom may support one or more reels and the reel means may be used for storing a flex able, roll able, elongated object such as a water hose, fiber optic cable, an air hose, a cable, a rope, a power cord or the like. When two or more types of flex able elongated objects are paired together is referred to as an umbilical cord.

It is an objective of the present invention to have one or more articulated boom arms mounted on the mobile platform. By having multiple boom assemblies it is practical to customize each boom for a specific category of service. For example, one boom assembly may position one or more reels adjacent to a work area, a second may position a vacuum hose adjacent to the work area and a third may support powered tools near a work area. The powered tools may include a submergible water pump, a valve exerciser, a torque wrench, a digging bucket, a hoe rain, a jack hammer, a concrete saw, a drill or the like.

It is an object of the present invention to provide a vehicle mounted vacuum excavation system with a vacuum hose reel pivot ably mounted adjacent to a side of the vacuum container and the vacuum hose reel allowing the vacuum hose to be used for vacuuming up solids or liquid while the vacuum hose is still partially rolled up on the vacuum hose reel and the vacuum hose reel being able to retract or dispense a length of vacuum hose as needed in order for the suction end of the vacuum hose to be placed near vacuum able solids or liquids. Positioning the vacuum hose reel on the side of the vacuum tank (as apposed to on top of the vacuum tank), allows the reel to rotate in a vertical plain around a horizontal axis thus placing the vacuum pose in a user friendly position near the operator and a jetter water hose reel. Having the hose closer to the ground makes the vacuum hose much easier for the operator to access.

It is an object of the present invention to provide a vehicle mounted vacuum excavation system with a vacuum hose reel pivot ably mounted adjacent to a vacuum container and said vacuum container also adding structural support to said pivot ably mounted vacuum hose reel and the pivot ably mounted vacuum hose reel having a means for rotating said hose reel in order to retract or dispense a length of vacuum hose as needed in order for the suction end of the vacuum hose to be placed near vacuum able solids or liquids and said means of rotating said hose reel being chose from a group consisting of a handle for manually rotating said hose reel, an electric motor, a hydraulic motor, an air motor, a vacuum motor, or the like.

It is an object of the present invention to provide a vehicle mounted vacuum excavation system with a vacuum hose reel pivot ably mounted adjacent to a vacuum container and the pivot ably mounted vacuum hose reel having a means to rotate said hose reel in order to retract or dispense lengths of vacuum hose as needed in order for the suction end of the vacuum hose to be placed near vacuum able solids or liquids and said means of pivot ably attaching said vacuum hose reel to said vacuum container being chosen from a hollow shaft with bearings, a hollow shaft with seals, a slewing ring gear drive such as a Model S-9 hourglass worm slew drive made by Kinematics Mfg. Inc., or the like.

It is an object of the present invention to provide a vehicle mounted vacuum excavation system and water jetter system, with a vacuum hose reel pivot ably mounted adjacent to a vacuum container and the pivot ably mounted vacuum hose reel having a means to rotate said hose reel in order to retract or dispense a length of vacuum hose as needed in order for the suction end of the vacuum hose to be placed near vacuum able solids or liquids and said vacuum hose having an articulated support means pivot ably mounted adjacent to a jetter hose reel.

It is an object of the present invention to pivot ably mount a first end of a boom arm on a mobile platform, and mount a hose reel near the second end of the boom arm, so that the weight of the hose reel is supported by the boom arm and the boom arm can also move the hose reel to a user friendly position for use of the hose by an operator.

Another object of this invention is to have a hose reel articulation method which will allow an operator to move a hose reel from a stored position to a user friendly operating position with ease.

Another object of this invention is to have a mobile boom articulation method which will allow an operator to move a reel to a desired position within a three dimensional space adjacent to the base to which the articulated boom arm is attached.

Another object of this invention is to have a mobile boom articulation method which will allow an operator to move a reel to a desired position within a three dimensional space adjacent to the base to which the articulated boom arm is attached and said reel being chosen from a group consisting of a conduit reel, hose reel, a power cord reel, a fiber optic reel, a rope reel, and a cable reel.

It is an object of the present invention to pivot ably mount a first end of a boom on a mobile platform, and mount two or more reels near the second end of the boom arm, so that the weight of the reels is supported by the boom and the boom can also move the reels to a user friendly position for use by an operator. The different reels may for example include a jetter hose reel to clean a drainage pipe and a cord reel to supply electronic communication and power to a camera which can document the condition of the drainage pipe. Another example of the types of reel would be a jetter hose reel to clean a drainage pipe and a cable reel to lift a dredge which lifts debris from a man hole.

It is an object of the present invention to position sensors, monitors, controllers, and mechanical hardware adjacent to the boom in order to operate the boom, the reels, and the utility servicing operation.

It is an object of the present invention to position a wireless data storage and data retrieving means at the access to utilities. The access to a utility being defined as a man hole, a valve box, a meter box or the like.

It is an object of the present invention to provide a mobile vehicle having an engine, a water storage tank, a water pump, a water jetting hose reel assembly, sensors to sense at least one parameter chosen from a list comprising, jetter water pressure, jetter flow rate, length of hose dispensed, distance the jetter hose is dispensed into a drainage pipe, location of an obstruction or clog in a pipe, length of hose remaining on the reel, torque required to rotate the hose reel, hydraulic pressure required to rotate a hose reel hydraulic motor, voltage and amps to power an electric hose reel drive motor, Global Positioning System location of a utility, Global Positioning System location of service work, GPS documented time and date of service work starting and completing, cameras, digital video to determine the need for servicing a utility and digital video to document that a utility service has been accomplished, digital measuring cameras, CMOS cameras, CCD cameras that use time of flight principals which may be used to determine the size of items within a pipe, lasers and sonar to accomplish in ground mapping of utility piping, Radio Frequency Identification Device to document operator data and accessibility to operating functions, text, digital data logging, and Radio Frequency transmissions; and having a data gathering, storage, and transporting means such as a USB thumb drive, blue tooth transmission or the like, or wired or wireless transmission to a computer and utility data storage program such as a GIS utility mapping program.

It is an object of the present invention to place Global Positioning System apparatus adjacent to the reel for the purpose of identifying the position and time that utility service work takes place.

It is an object of the present invention to position within a utility conduit such as a man hole or drainage pipe; a remotely controlled robotic arm having a first end attached to a remotely position able secure platform and having a tool attachment hand attached to to a second end of said robotic arm. Wherein said remotely position able secure platform can be an inflatable balloon positioned at a predetermined position with in a utility man hole or pipe. After the balloon is positioned to an acceptable position with in a pipe, a control system activates the inflation of the balloon with a gas or liquid thus pressing the outside wall of the balloon against the inside wall of the utility conduit.

It is an object of the present invention to use a water/sand combination under pressure to cut pipes underground. It is a further objective to add an inflatable balloon near the nozzle end of a jetter hose in order to establish a stabile platform for articulating a water/sand cutting nozzle, It is a further objective of the present invention to have a remote operated articulated boom attached between the inflatable balloon and the water/sand cutting nozzle, It is a further objective of the present invention to have a camera positioned in proximity to the cutting nozzle for observing the cutting operation. It is also an objective to have an air compressor means onboard the mobile platform for supplying air under pressure for controls and service work and for operating air tools.

It is an object of the present invention to place a Radio Frequency Identification Devices adjacent to the reel for the purpose of identifying or giving operational access to personal.

It is an object of the present invention to position sensors and transmitters adjacent to the reel to allow wireless communication and control of data associated with the operation and interaction of equipment and the utilities.

It is an object of the present invention to use a motor to wind the reel and it is an objective of the present invention to monitor and document the torque required to turn the reel.

It is an object of the present invention to have a sensor means to monitor the length of cable or hose that is dispensed from the reel. A sensor means can measure and count the feet or units lengths of cable or hose as it is being dispensed and rewound onto the reel.

It is an object of the present invention to have a cable reel to pull cable through a conduit or pipe and to monitor the torque required to pull the cable. The cable reel can use the cable to pull electrical wires through a conduit or to pull a cleaning tool through a drainage pipe in order to remove debris or dirt and rocks.

It is an object of the present invention to provide a stabilizing arm such as a tripod to support the reel over a man hole during periods of high torque pulling of a cable. The stabilizer can be in the form of an outrigger.

It is an objective of the present invention to provide a stabilizing arm with guides or rollers to assist in supporting a hose or cable while pulling the hose or cable from a lateral drainage pipe and a man hole.

It is an object of the present invention to provide a jetter hose reel having a source of pressurized water and a jetter hose and a jetter nozzle. A further objective is to use pressurized water from the jetter nozzle to loosen dirt and debris which has accumulated in a drainage pipe. It is a further objective of this patent to use the jetter nozzle to pierce through a clog in a drainage pipe. The jetter nozzle may also transport a mechanical wedge or an inflatable base into a utility conduit. The jettering action of the jetter nozzle can cut a hole through a clog in a conduit large enough for transporting a collapsible wedge through the hole in the clogged conduit. The collapsed wedge may then be expanded and pulled back through the conduit, thus pulling the clog material with it. The wedge may be attached to the jetter hose. A cable may be attached to the wedge. A second reel may serve as a wench for using the cable for retrieving the wedge. The wedge may be expanded mechanically, or it may be inflated with a gas or liquid.

It is an object of the present invention to use a slewing ring gear drive as the bearing support and rotational axis means to articulate the boom arm in relation to the mounting base on the mobile vehicle. An example of a slewing ring gear drive could be a Model S-9 hourglass worm slew drive made by Kinematics Mfg. Inc.

It is an object of the present invention to power a slewing ring gear drive with a hydraulic motor or electric motor.

It is an object of the present invention to use the motor driven slewing ring gear drive to both rotate the boom arm and to secure the boom in position after rotation is completed. It is important to securing the position of a hose reel in relation to a man hole or work station while service work is being accomplished, and the motor driven slewing ring gear drive stabilizes the boom in position until power is reapplied in order to further rotate the boom arm.

It is an object of the present invention to use the jetter hose reel articulated boom arm to position the hose reel at times near the access door of a vacuum tank and to also move the hose reel clear of the vacuum tank access door in order to open said access door: and it is a further object to provide controls and switches to insure that the articulated boom and hose reel are clear of the vacuum tank access door when opening said vacuum tank access door.

Prominent features of the present invention have been broadly outlined above in order that the detailed description that follows may be understood. There are additional features of the invention that will be described hereinafter and which will form the subject matter of the claims appended hereto.

BRIEF DESCRIPTION OF THE DRAWINGS

FIG. 4 is a top view similar to FIG. 2 wherein FIG. 4 shows an example of adding multiple arms and multiple pivot axes to the boom in order to add additional flexibility to the articulation of a reel. This drawing also shows that multiple pivot axes connections may be upgraded from a simple support and shaft to a worm slew drive with a motor to power the worm drive. However the worm drive could be a simple hand crank.

FIG. 5 shows from a side view, an example of adding multiple arms and multiple pivot axes to the boom for both horizontal and vertical movement in order to add three dimensional movement to positioning the reel. This drawing also shows that multiple pivot axes connections may be upgraded from a simple support and shaft to a worm slew drive with a motor to power the worm drive. However the worm drive could be a simple hand crank.

FIG. 6 shows an example of the present invention which illustrates mounting multiple reels on a single boom. Each reel can be dedicated to a different function. For example, one reel may be a jetter hose reel for using pressurized water to remove dirt from a drainage pipe; a second reel may be a power cord reel to supply power, electronics or fiber optics to cameras and sensors in order to monitor the progress of the jetter cleaning service; yet another reel could be a cable reel used as a wench in order to pull mechanical cleaning tool through the drainage pipe.

FIG. 7 is a side view showing a example of the present invention pulling a mechanical pipe cleaning tool through a pipe. The debris shows a hole through it that was pierced with a water jetter nozzle from a second hose reel. The jetter hose reel can dispensed jetter hose simultaneously with the cable reel, thus the jet action of the jetter nozzle could pull both the cable and the jetter hose to a second man hole provided the ends of hose and the cable were temporally connecter. Thus the mechanical pipe cleaning tool is attached to the cable at the second man hole. However, a collapsible/expandable mechanical pipe cleaning tool could be used if a convenient second manhole was not near by. FIG. 7 also illustrates a sample method of using an out rigger to further support the second end of a boom. FIG. 7 also illustrates a sample method of placing guiders, rollers or support for a cable or hose which may be pulled through a man hole lateral line.

FIG. 7B illustrates the wedge in a collapsed and flattened position while being pulled by a jetter nozzle.

FIG. 8 is a side view of a similar mobile vehicle and boom arrangement as FIG. 7. However, FIG. 8 further illustrates the versatility of the present invention to place a variety of tool systems onto a compact mobile utility service vehicle and further be able to position the tools in a user friendly fashion near the operators work area. FIG. 8 illustrates a power, electronic and fiber optic cord reel having a camera attached and moved through a pipe to observe the condition of the pipe. In this example the camera has the ability to video the conditions and to take digital measurements of repair areas using CMOS cameras, and CCD cameras that use time of flight principals to measure the size and position of items.

Thus the documented location, visual condition and actual dimensions will be used to prepare for repairs.

Figure 7:
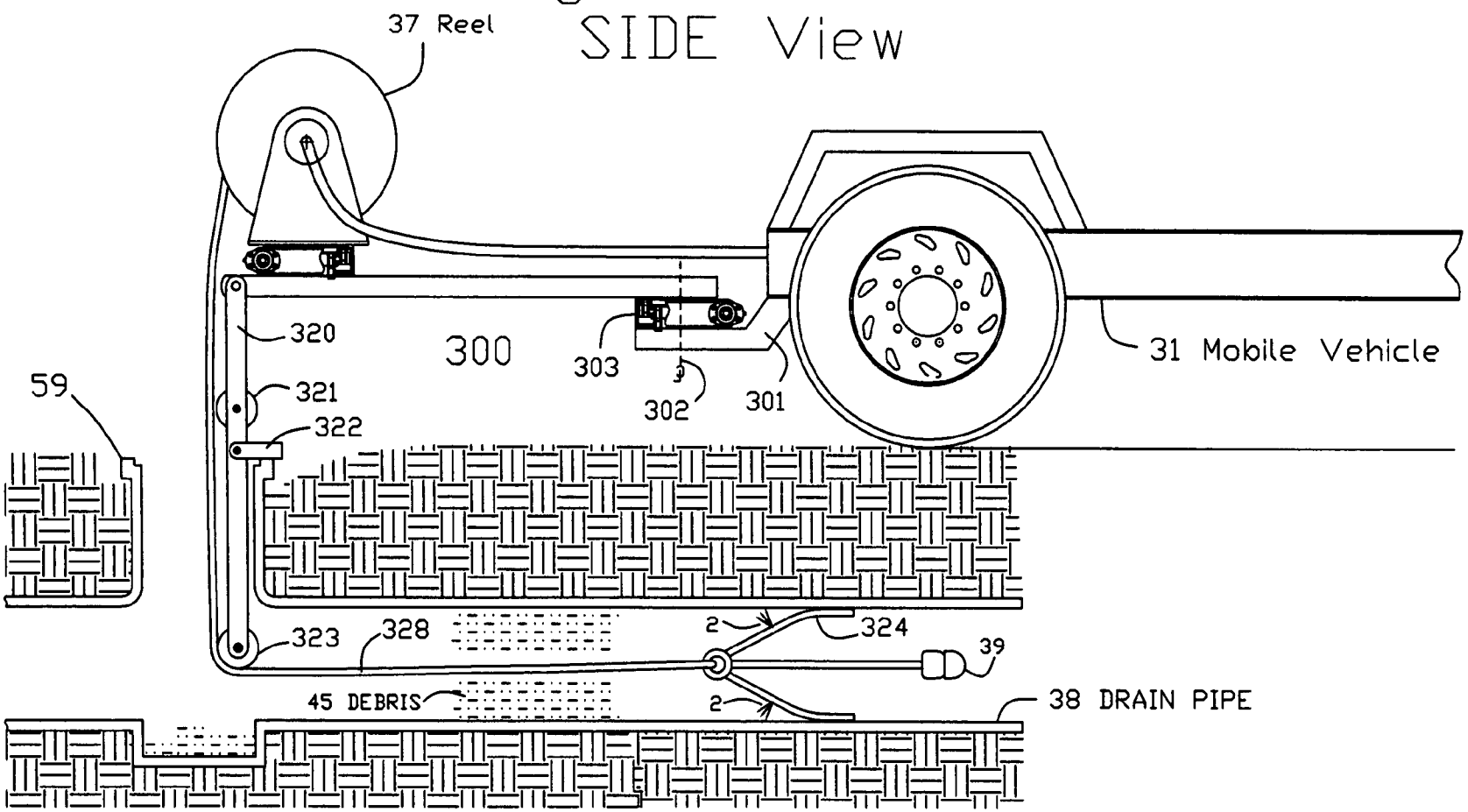
Figure 9:
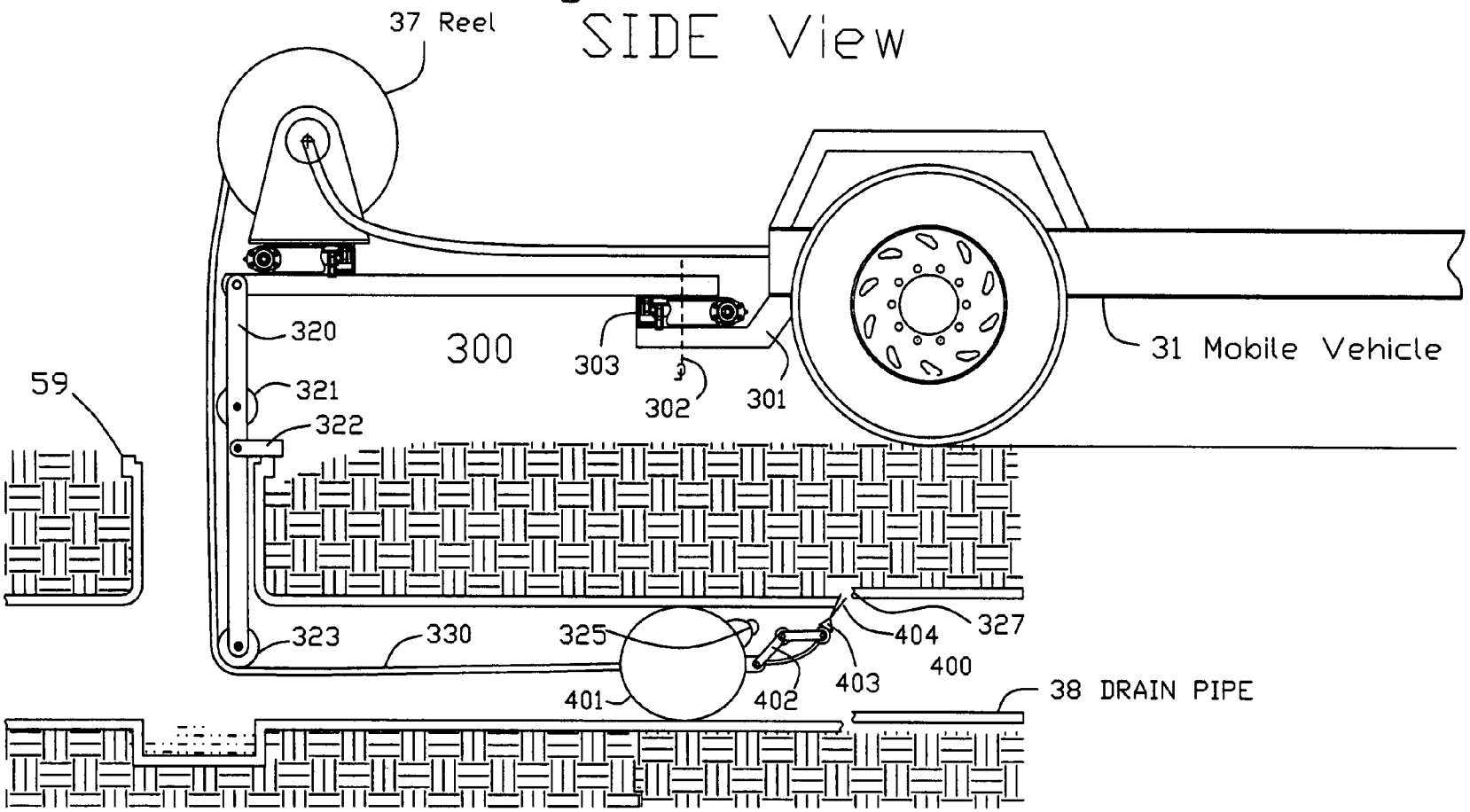

FIG. 9 is a side view of a similar mobile vehicle and boom arrangement as FIGS. 7 and 8. How ever FIG. 9 further illustrates the versatility of the present invention to place a variety of tool systems onto a compact mobile utility service vehicle and further be able to position the tools in a user friendly fashion near the operators work area. FIG. 9 illustrates an example of the present invention placing within a utility conduit; a remotely controlled robotic arm having a first end attached to a remotely position able secure platform and having a tool attachment hand attached to a second end of said robotic arm. Wherein said remotely position able secure platform can be an inflatable balloon positioned at a predetermined position with in a utility man hole or pipe. After the balloon is positioned to an acceptable position with in a pipe, a control system activates the inflation of the balloon with a gas or liquid thus pressing the outside wall of the balloon against the inside wall of the utility conduit. A jetter nozzle 39 may be used for transporting the inflatable base 401 into position within a conduit. In the illustration of FIG. 9 the robotic arm is positioning a pressurized water/sand nozzle into position to cut out a broken section of pipe that needs repaired. The inflatable balloon is also shown to position a camera in place.

Figure 1:
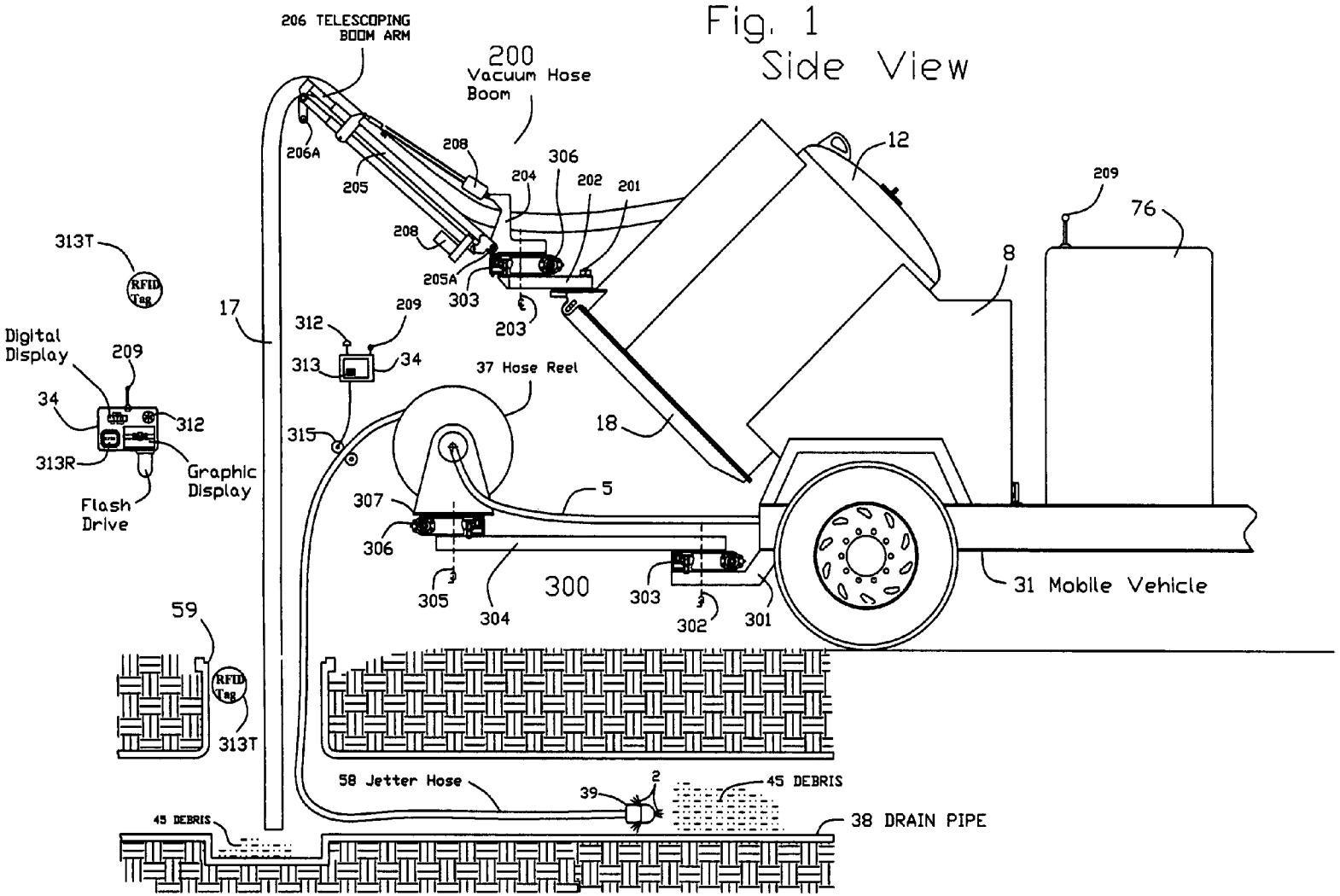
FIG. 1 is a side elevation view of the mobile sewer and drainage pipe cleaning utility service vehicle of the present invention wherein the arrangement includes a jetter system to dislodge dirt and debris from a drainage pipe and further includes a vacuum system to remove the dislodged debris and dirt from the drainage pipe and man hole and the present invention is shown to use multiple articulated booms to position the utility servicing hoses and controls within user friendly proximity of a manhole so that an operator has efficient access to the controls, vacuum hose and jetter hose.
Figure 10:
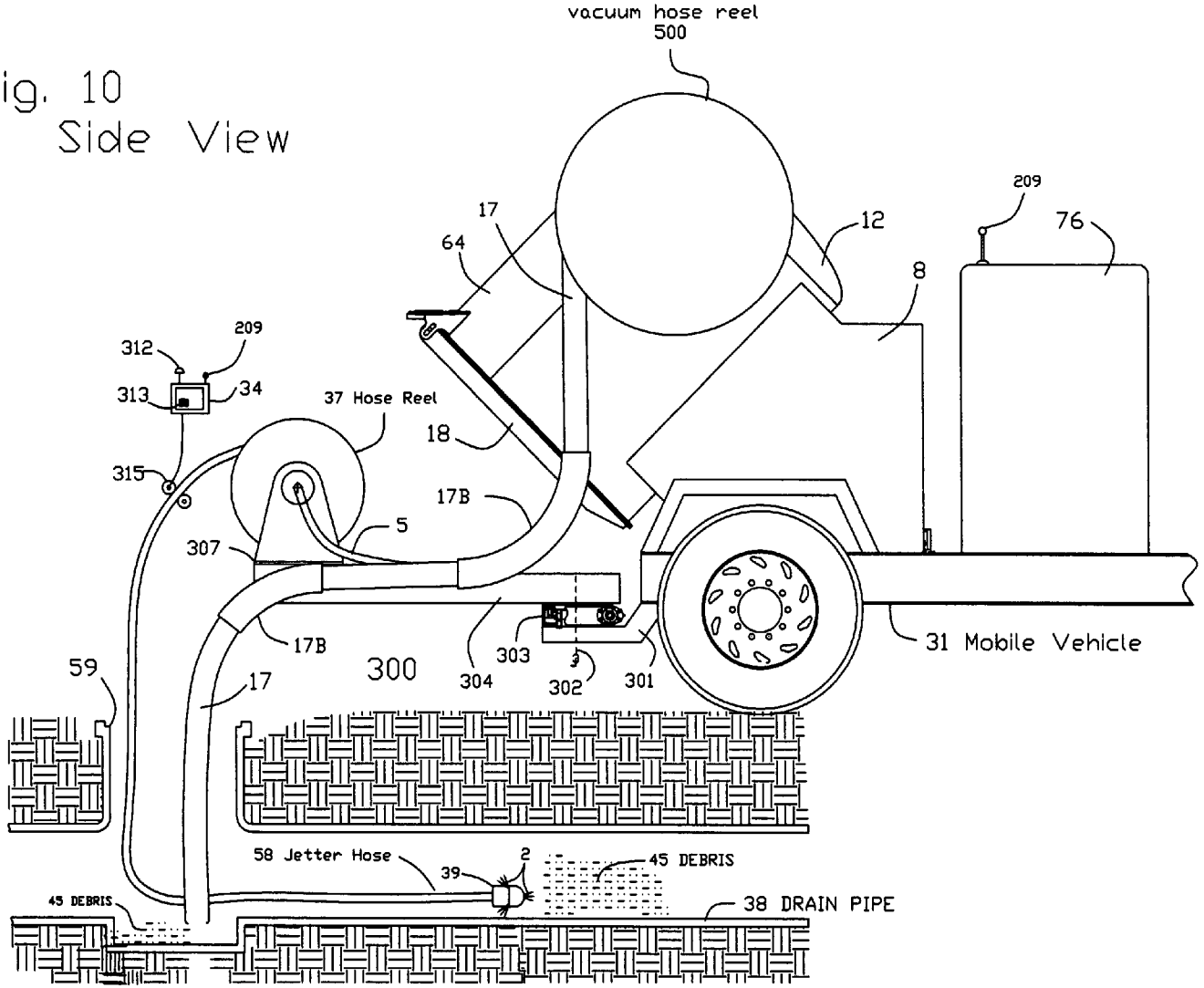

FIG. 10 is a side elevation view similar to FIG. 1 except that a vacuum hose reel is shown pivot ably attached and supported by the vacuum container. The vacuum hose that has been dispensed from the vacuum hose reel is shown to be supported and positioned by two ell shaped conduits which are attached to the jetter boom. The suction end of the vacuum hose is shown to be vacuuming solids or liquid from a utility man hole basin.

Figure 11:
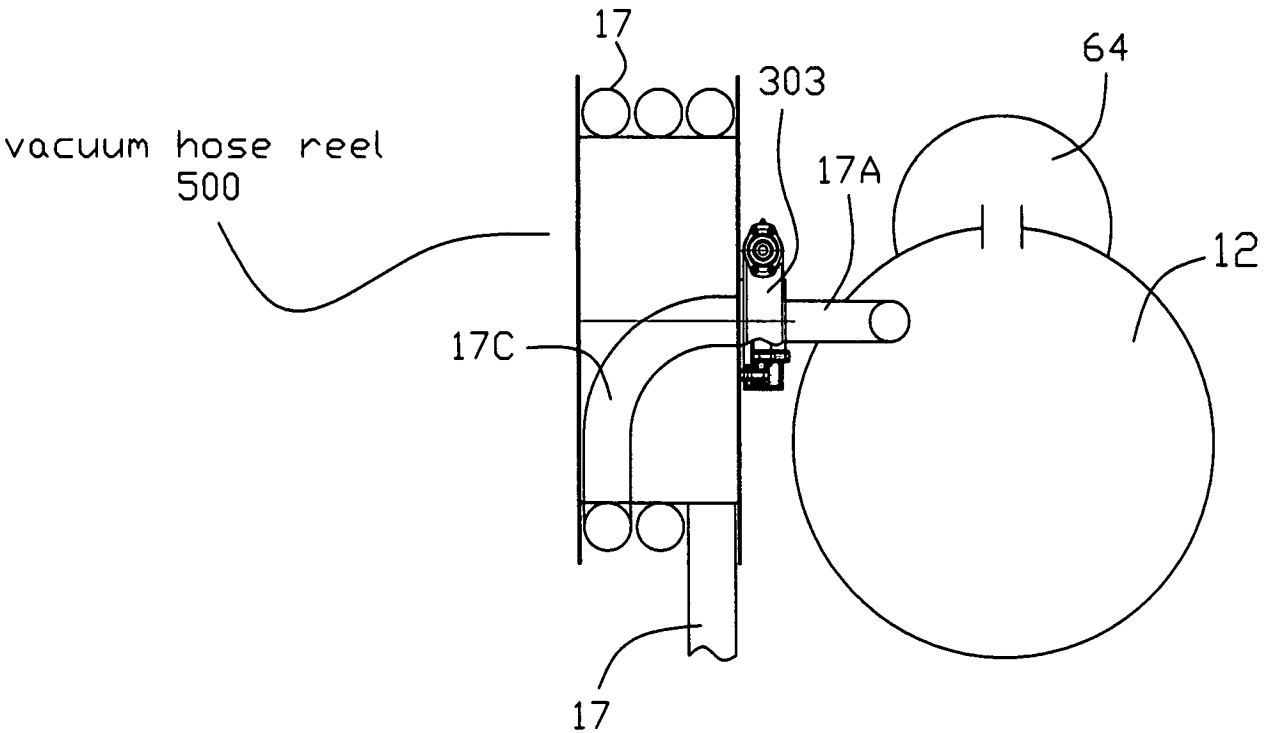

FIG. 11 is a cross section end view showing a vacuum hose reel pivot ably attached to a vacuum container by means of a ridged vacuum conduit pipe extending from the vacuum container. The Vacuum container is shown to supports the ridged vacuum conduit pipe which in turn is shown to support a rotate able mounting attachment which has bearings and seals. The rotate able mounting attachment is shown to be supporting the vacuum hose reel. In this drawing, the rotate able mounting attachment with its bearings and seals is shown to be an hourglass worm slewing ring gear drive. An electric motor, a hydraulic motor or a handle may be used to rotate the hourglass worm slewing ring gear drive which then turns the vacuum hose reel in order to retract or dispense a length of vacuum hose. The rotate able mounting attachment could be a bearing and seal, a flange and seal or a pipe with a seal and flange.

Figure 12:
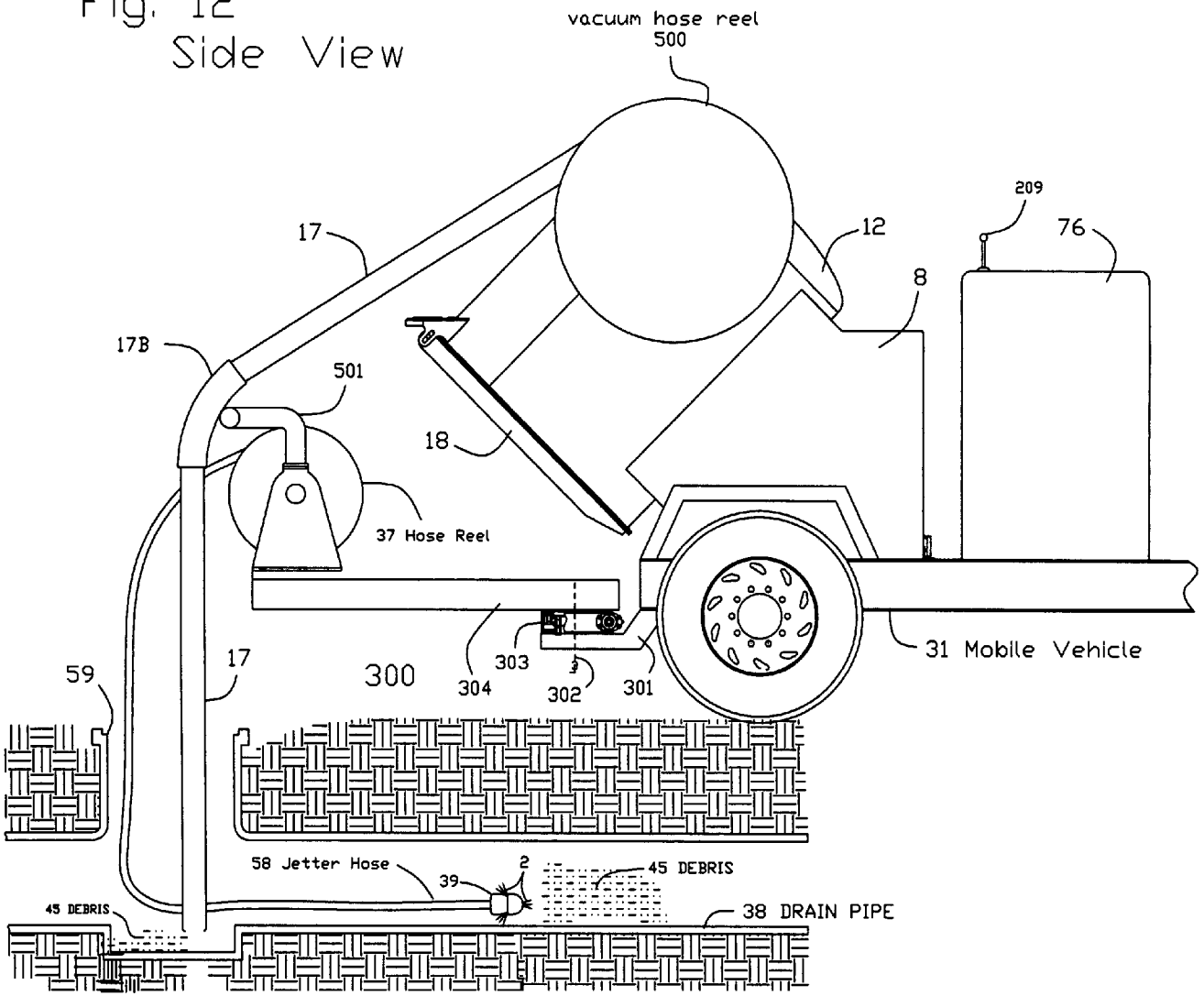

FIG. 12 is a side view similar to FIG. 10 except that in FIG. 12 a vacuum hose guider support is shown to be supported by a pivot ably mounted, articulated hose guider support boom arm, and said pivot ably mounted, articulated hose guider support boom arm is shown to be mounted adjacent to a jetter hose reel. The vacuum hose guider support can be a length of conduit or it can be a sleeve that the vacuum hose slides through or it can be an arrangement of rollers that serve to support and or guide the vacuum hose. Said rollers may be idler rollers or driven rollers used to assist in dispensing or retracting the vacuum hose. The suction end of the vacuum hose is shown to be vacuuming solids 45 or liquid 2 from a utility man hole basin 59.

Figure 13:
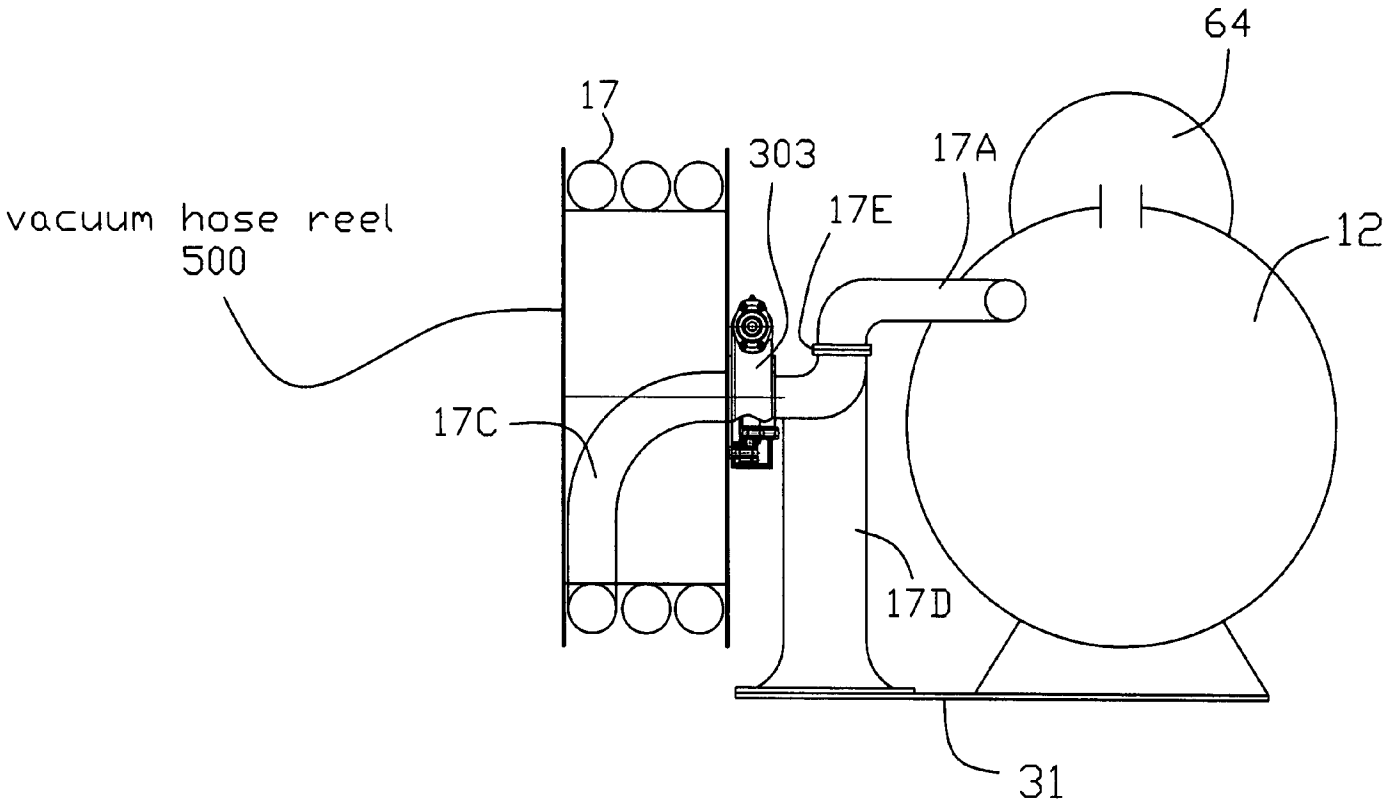

FIG. 13 is an end view of a vacuum hose reel which is shown to be pivot ably mounted adjacent to a vacuum container, but said vacuum hose reel is shown to be supported on a mobile vehicle platform by a vacuum hose reel support. A vacuum conduit connector is shown to connect the ridged vacuum conduit pipe to the vacuum conduit piping of the rotate able mounting attachment. The vacuum conduit connector can be a ridged fixed connector or it can be a quick release connector or a compression type seal connection which will separate in order to allow a vacuum container to be raised for unloading solids.

DETAILED DESCRIPTION OF THE PREFERRED EMBODIMENTS

Using the drawings, illustrations of the present invention will now be explained.

FIG. 1 shows a side view of a compact, user friendly, multi tool, mobile vacuum excavation and jettering and service machine for accessing, inspecting, testing, cleaning and repairing a utility conduit 38 such as a storm drain, sewer, or the like. The machine includes a mobile platform 31 such as a skid, a trailer, a truck, a barge, a rail car, a skid steer, a tracked vehicle, an all terrain vehicle, and the like.

FIG. 1 illustrates a power plant 76 positioned on the mobile platform 31. The power plant 76 may include one or more of a group comprising an engine, a vacuum blower, a water pump, Power Take Off, a split case drive unit, a hydraulic pump, an air compressor, sand or glass bead storage, a DC generator, a battery, an AC generator, a welder, a laser generator, a water heater, a fuel tank, a hydraulic tank, an enclosure, process controls, a data logger, a computer, and the like. A purpose of the power plant 76 is to provide a variety of utilities and multiple power sources to the operator in order to operate each tool needed to accomplish all phases of his accessing, testing, cleaning and repairing utility conduits 38.

FIG. 1 illustrates that a wireless transmitter/receiver 209 may be positioned as needed on the mobile platform 31.

FIG. 1 also illustrates that a wireless RFID tag 313T may be placed adjacent to a man hole or utility access such as a valve box or meter box, in order to communicate with a wireless RFID reader 313T which is a part of the mobile platform 31. Thus data, gathered by a mobile platform 31 inspection, cleaning or service work, can be stored onto a monitor/controller 34 and later be retrieved by a passerby utility worker with an RFID reader 313R which has the RFID tag code saved with the service event information and code. This method of data gathering, storing and retrieving allows for information concerning a specific utility condition to be readily available at the utility access in addition to being stored on the mobile platform 31 and on a central utility mapping program, and the like. There for an RFID reader 313R stores information respective to a service event and the RFID tag 313T contains a code specific to the RFID tag 313T and said RFID reader 313R associated said code with said stored information when activated by a signal between said RFID tag 313T and said RFID reader 313R. Placing the RFID tag 313T in close proximity to the RFID reader 313R allows communication between them thus information pertaining to a service event may be retrieved by positioning said RFID tag in proximity to said RFID reader.

A monitor/controller 34 to display gathered data to an operator may be hand held or positioned on the mobile platform or be adjacently mounted at a utility access such as a man hole or the like.

A GPS 312 is shown in drawing 1 to be a part of the mobile platform 31 monitor/controller 34. How ever the GPS 312 could be placed on or near the service utility that is being cleaned or repaired.

An RFID 313, in FIG. 1 is shown to be a part of the monitor/controller 34, however an RFID 313 could be placed as a single operator sign in for each operator on each function of the machine.

FIG. 1 illustrates a side view of a vacuum system being used to vacuum earthen material 45 from a man hole 59. The vacuum system includes a vacuum tank 12 having a vacuum producing means to create a vacuum environment within the vacuum tank 12, an air filter housing 64 with filters disposed within, a vacuum hose 17 which is used to vacuum solids or liquid into the vacuum tank 12, and an access door 18. By opening access door 18, solids or liquid can be emptied from the vacuum tank 12.

FIG. 10 illustrates a side view of a vacuum hose reel 500 which is shown to be pivot ably mounted adjacent to a vacuum container 12 and said vacuum hose reel 500 is also supported by a length of ridged vacuum conduit 17A which is in turn supported by the vacuum container 12. In FIG. 13 the vacuum hose reel 500 is shown to be pivot ably mounted adjacent to a vacuum container 12 but said vacuum hose reel 500 is shown to be supported on a mobile vehicle platform 31 by a vacuum hose reel support 17D. The vacuum hose reel 500 is shown to be mounted on the side of the vacuum container 12. The vacuum hose reel 500 is supported by a horizontal ridged vacuum conduit pipe 17A thus the reel 500 can rotate in a vertical plain. A vacuum conduit connector 17E is shown to connect the ridged vacuum conduit pipe 17A to the vacuum conduit piping of rotate able mounting attachment 303. The vacuum conduit connector 17E can be a ridged fixed connector or it can be a quick release connector or a compression type seal connection which will separate in order to allow a vacuum container 12 to be raised for unloading solids.

In FIG. 10 the vacuum hose 17 has been dispensed from the vacuum hose reel 500 and the vacuum hose 17 is shown to be supported and positioned by two vacuum hose guider supports 17B which are shown in this example to be attached to the jetter boom 300. In FIG. 12 a vacuum hose guider support 17B is shown to be supported by a pivot ably mounted, articulated hose guider support boom arm 501 and said pivot ably mounted, articulated hose guider support boom arm 501 is shown to be mounted adjacent to a jetter hose reel 37. The suction end of the vacuum hose 17 is shown to be vacuuming solids 45 or liquid 2 from a utility man hole basin 59. The vacuum hose guider support 17B can be a length of conduit or sleeve that the vacuum hose 17 slides through or it can be an arrangement of rollers that serve to support and or guide the vacuum hose 17. Said rollers may be idler rollers or driven rollers used to assist in dispensing or retracting the vacuum hose 17.

FIG. 10 and FIG. 12 illustrate the vacuum hose reel 500 rotate ably mounted and supported by a vacuum container 12 and the vacuum hose reel 500 is also illustrated to rotate around a horizontal axis, however the vacuum hose reel 500 could also be mounted to rotate around a vertical axis instead or have an adjustable mount attached in such a way as to pivot said vacuum hose reel 500 from a horizontal to a vertical axis of rotation. The vacuum container 12 is illustrated to be of the incline slope design which is rigidly mounted and does not further incline in order to unload its contents. However, the vacuum hose reel 500 could be rotate ably mounted adjacently to a vacuum container 12 which is filled in a horizontal orientation and then inclined in order to unload its contents.

FIG. 11 illustrates a cross section end view of a vacuum hose reel 500 pivot ably attached to a vacuum container 12 by means of a ridged vacuum conduit pipe 17A extending from the vacuum container 12. In FIG. 11 the vacuum hose reel 500 is shown to rotate around a horizontal axes. The Vacuum container 12 is shown to give structural support to the ridged vacuum conduit pipe 17A which in turn is shown to give structural support to a rotate able mounting attachment 303 which has bearings and seals. The rotate able mounting attachment 303 is shown to be supporting the vacuum hose reel 500. The vacuum hose 17 is attached to the rotate able mounting attachment 303 by means of vacuum conduit connector 17C. In this drawing, the rotate able mounting attachment 303 with its bearings and seals is shown to be an hourglass worm slewing ring gear drive 303. An electric motor, a hydraulic motor or a handle may be used to rotate the hourglass worm slewing ring gear drive 303 which then turns the vacuum hose reel 500 in order to retract or dispense a length of vacuum hose 17.

FIG. 1 illustrates that the present invention includes using multiple articulated booms on a single machine. Vacuum hose boom 200 is shown as a means of mechanically positioning a suction end of a vacuum hose 17 into proximity with vacuum able earthen material 45 such as dirt, gravel, rocks, debris and the like. Vacuum hose boom 200 is versatile in its' range of movement. The range of movement of vacuum hose boom 200, is accomplished by having multiple axes of pivot ability, and multiple varieties of arms as illustrated in the FIG. 1. A first end of vacuum hose boom 200 is attached to the mobile platform 31 at a vertical axes means 201 thus giving arm 202 a range of horizontal pivoting. A second vertical axes means 203 gives the mounting base 204 a high degree of horizontal pivoting. Arm 205 is attached to mounting base 204 at a horizontal axes means 205A thus giving arm 205 a high degree of vertical pivoting. Arm 205 is shown to support a telescoping arm 206. Arm 205 is shown to be vertically pivoted by a powered telescoping means 208. The powered telescoping means 208 may be a linear actuator, a hydraulic cylinder, or the like. The movement of telescoping arm 206 is shown to be powered by a powered telescoping means 208. Vacuum hose 17 is shown to be supported by vacuum hose boom 200.

Vacuum hose boom 200 is illustrated to be placing the suction end of vacuum hose 17 down in a man hole 59 so that the vacuum hose 17 suction end can vacuum up solids or liquid which has been washed from a utility conduit 38 and into a man hole 59.

Vacuum hose boom 200 also has an auxiliary tool attachment means 206A which may be used to attach a submergible pump system, an earthen material 45 grinder system, a hydro-excavator system, an air excavator system, a wench system, and the like. The Vacuum hose boom 200 may be equipped with other utility distribution means to power said systems. Examples of the utility distribution means could be a hydraulic hoses, a water hoses, an air hose, an AC or DC power cords, a control wiring cord, a fiber optics cable, and the like.

FIG. 1 also illustrates a second articulated boom 300 mounted on the mobile platform 31. Boom 300 illustrates supporting and positioning a reel 37 near a man hole 59. Mobile platform 31 illustrates having a boom mounting base 301 for attaching boom 300. Boom mounting base 301 is illustrated as having boom 300 connected to base 301 via a vertical axes, pivot able mounting means 302. In FIG. 1, boom 300 is illustrated as pivoting horizontally in respect to mobile platform 31. However the pivot able mounting means 302 could be horizontal and still be used as defined by the present invention. The pivot able mounting means 302 or pivot able mounting means 305 could be a shaft with a sleeve, a shaft with bearings, a slewing ring gear or the like. For the purpose of illustration, the inventor has chosen to draw a slewing ring gear 303 as a preferred means to pivot ably mount the boom 300 to base 301. The slewing ring gear 303 may be of the model S-9 hourglass worm slew ring gear drive as made by Kinematics Mfg. Inc. or the like. The slew ring gear rotation means 306 may be a manual hand crank, a hydraulic motor, an electric motor, an air motor or the like. In the illustration drawings, the inventor has drawn a motor as an example of the slew ring drive rotation means 306. Boom arm 304 is illustrated as having a first end pivot ably mounted via slewing ring gear 303 to the mobile platform 31 boom base 301. A second end of boom arm 304 is supporting a reel 37. The reel 37 is illustrated as having a pivot able mounted means 305 near a second end of boom arm 304. As illustrated in FIG. 1 the reel 37 mounting base 307 is pivot ably mounted near a second end of boom arm 304 via a slewing ring gear 303 which is rotate able using a motor 306.

As illustrated in FIG. 1, the reel 37 may be used as a hose reel, a cord reel, a cable reel or the like. The Jetter hose reel 37 is illustrated to have pressurized water supplied to it through a water hose 5. A water storage container 8 is mounted on the mobile platform 31. A power plant 76 water pump takes water 2 from the water storage container 8 and pumps the water 2, under pressure, to the jetter hose reel 37 via water hose 5. A jetter hose 58 is shown to transport the pressurized water 2 from the jetter hose reel 37 to a jetter nozzle 39. The jetter nozzle 39 is shown to dispense a first portion of the water 2 backwards (in the direction the jetter hose 58) thus this first portion of the water 2 serves to propel the jetter nozzle 39 and jetter hose 58 forward (like the principle of using a jet engine). This water 2 jet propulsion drives the jetter nozzle 39 forward through the utility conduit 38 and into contact with any obstruction of earthen material 45 which may be clogging the utility conduit 38. A second portion of the water 2 is illustrated to be dispensed forward of the jetter nozzle 39. This second portion of water 2 may be used to erode away earthen material 45 which may be clogging the utility pipe 38. It is best to enter and clean a utility conduit 38 from the down hill end thus the water flows by gravity to a man hole on the down hill end of the utility conduit 38. Another us of the jettered first portion of water 2 is to wash the eroded earthen material 45 out of the utility conduit 38 and into a man hole 59 where the water 2 and earthen material 45 can be vacuumed up by the suction end of vacuum conduit 17.

It is important to monitor and to document most aspects of the inspection, cleaning service and repair operation. It is customary for utility companies to maintain documentation and mapping programs on their utility network. They need to further document all changes made to a utility because each change can have a reactive affect on other parts of the system. Thus data, associated with the inspections, cleaning, and servicing of a utility, needs to be gathered, transmitted and stored in a useful manner in the records of the utility company. FIG. 1 illustrates data gathering, transmitting, storage, monitoring, computing, controlling, and the like, of information associated with the machine's involvement in inspecting, cleaning or servicing a utility.

In FIG. 1 an RFID 313 is illustrated as a part of the present invention for a purpose of having an operator log in before starting to operate the machine. This RFID 313 sign in documents pre required data about who the operator is and denies access to a person not pre approved and trained to operate a function of the machine.

In FIG. 1 a GPS 312 is illustrated as a part of the present invention for a purpose of using the Global Positioning System as a means of documenting the geographic location of a utility, the location that a service was performed, and the date and time a service started, how long it took to perform a service and when the service was completed.

In FIG. 1 a transmitter/receiver 209 is illustrated as a part of the present invention for a purpose of communicating data by wireless transmission.

In FIG. 1 a monitor/controller 34 is illustrated as a part of the present invention for a purpose of placing information and a means to use the data in a user friendly position for an operator. The monitor/controller 34 can be hand held or mounted accessible to the operator via by sight and tough or wirelessly via a remote computer.

In FIG. 1 a hose/cable measuring system 311 is illustrated as a part of the present invention for a purpose of sensing the direction a jetter hose 58 is traveling, the speed it is traveling at and the distance it has traveled. In other examples of the present invention the hose/cable measuring system will work similar to sense measuring parameters of a power cord, fiber optic cable, air hose, cable, or the like.

Figure 2:
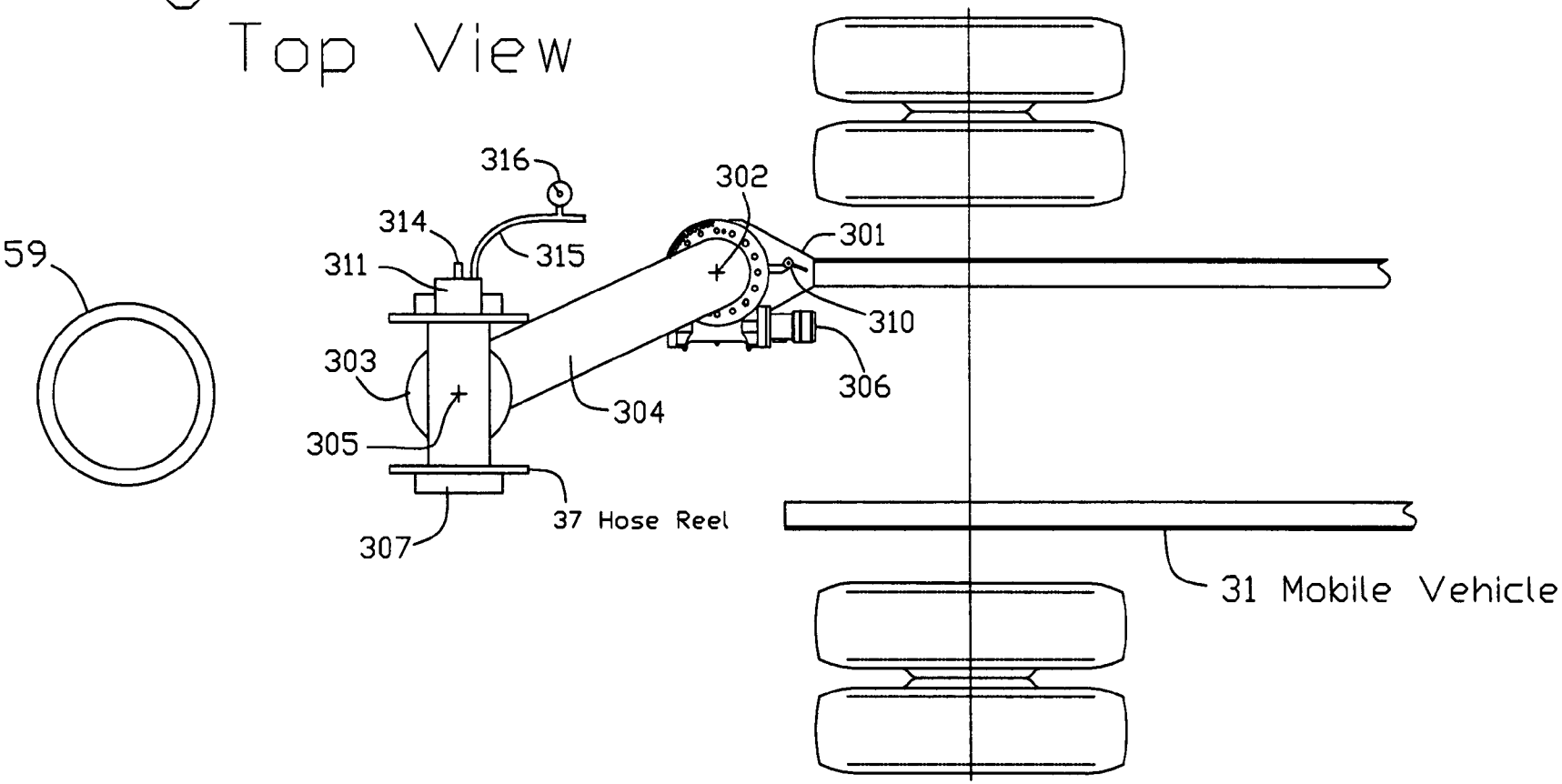
FIG. 2 is a top view of an embodiment of the present invention showing a reel supported on the second end of an articulated boom. The reel is shown to have a manually operated swivel base between the reel and the boom. The first end of the boom is shown to be supported by an hourglass worm slew drive which is motor drive. The worm slew drive is shown to be mounted on a mobile vehicle base. The boom and reel are shown to be positioned to the rear of a vehicle and near a manhole. The reel is shown to have a motor attached to it for dispensing or retracting a hose or cable. Sensors are shown to monitor operating parameters such as speed, torque, direction of rotation. Limit switches are shown which can be used to insure positioning of the boom arm.

In FIG. 2 a monitored, power means of dispensing or retrieving a hose or cable from reel 37, is illustrated as a part of the present invention. A motor 311 is illustrated as being a means to turn reel 37. The motor 311 could be an electric motor, a hydraulic motor or the like. 315 is illustrated as an energy source line to motor 311. Sensors are illustrated to determine one or more parameters associated to the operation of reel 37. Examples of the sensors are illustrated as a rotation sensor 314 which may detect the direction of rotation, speed of rotation or number of rotations. Torque sensor 316 may sense the pressure, temperature and or flow of hydraulic fluid through a hydraulic line 315 to a hydraulic motor 311. Torque sensor 316 may sense the voltage and or amperage of electricity going through power cord 315 to an electric motor 311.

FIG. 2 illustrates that the articulated boom 300 can pivot a reel 37 horizontally to a position at the rear of a mobile vehicle 31. (Note: mobile platform 31 can have one or more boom mounting base 301 at the front and or side of a vehicle, depending on a users preference of use.) Positioning sensors 310 can inform an operator of the degree of rotation the boom arm 304 is at. The position sensor 310 can also limit the degree of rotation of boom arm 304. The position sensor 310 can also restrict an access door 18 from opening if the boom 300 or reel 37 is in the way of opening access door 18, and the like.

Figure 3:
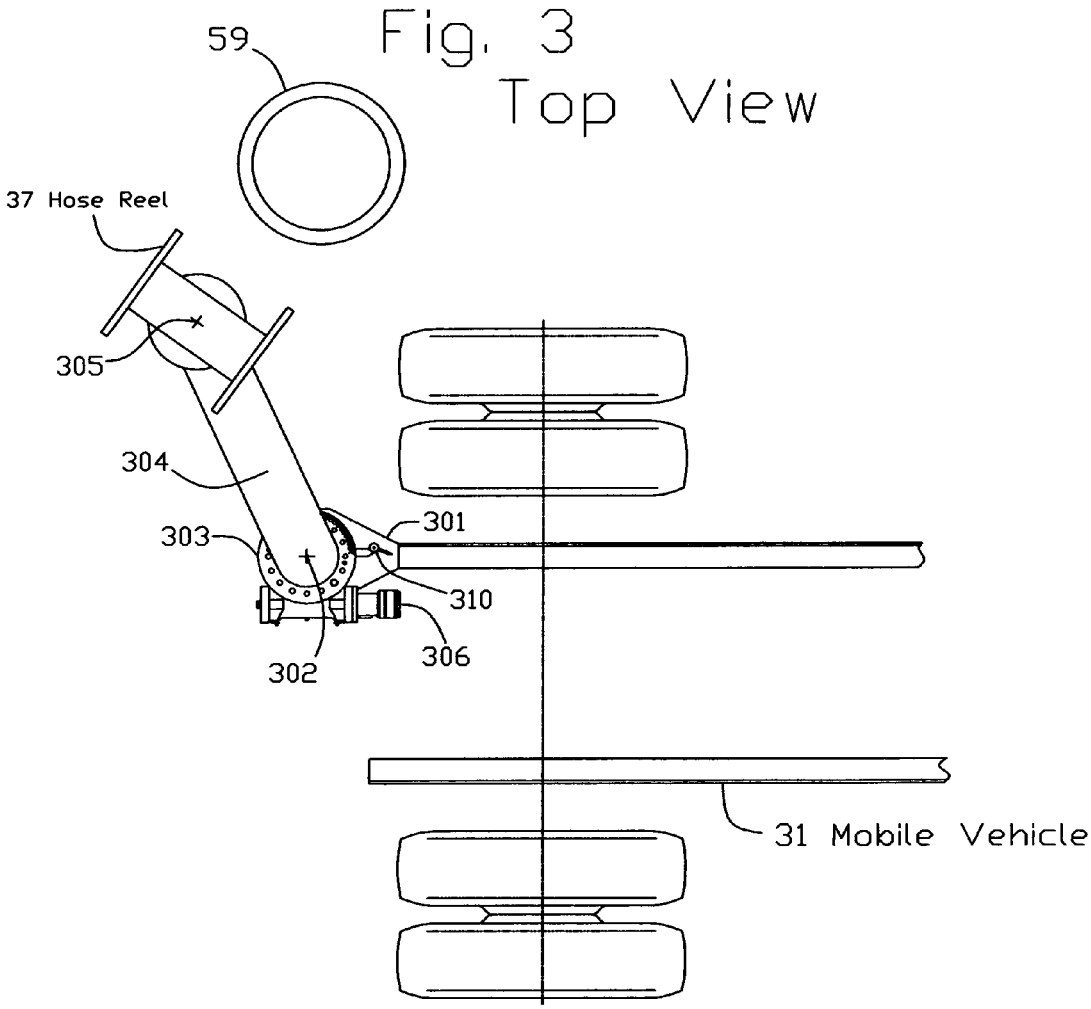
FIG. 3 is a top view similar to FIG. 2 except that the boom arm is shown to be rotated in order to position the hose reel to the side of the mobile vehicle instead of being behind the vehicle. In this arrangement a man hole located to the side of the vehicle is being accessed by the hose reel. The Hose reel is also shown to be able to swivel on a base on the second end of the boom arm. The boom arm could also be rotated as shown in FIG. 3 for the purpose of clearing the access area to a vacuum tank access door, and the limit switches could be used to verify that the boom and hose reel are clear of a vacuum tank access door. The limit switches could also be used to stop the access door from being opened unless the boom and reel were clear of the vacuum door access area.

FIG. 3 illustrates the present invention's use of boom 300 to move the reel 37 into a used friendly relation to a man hole 59, wither the man hole 59 is behind or to either side of mobile vehicle 31.

Figure 4:
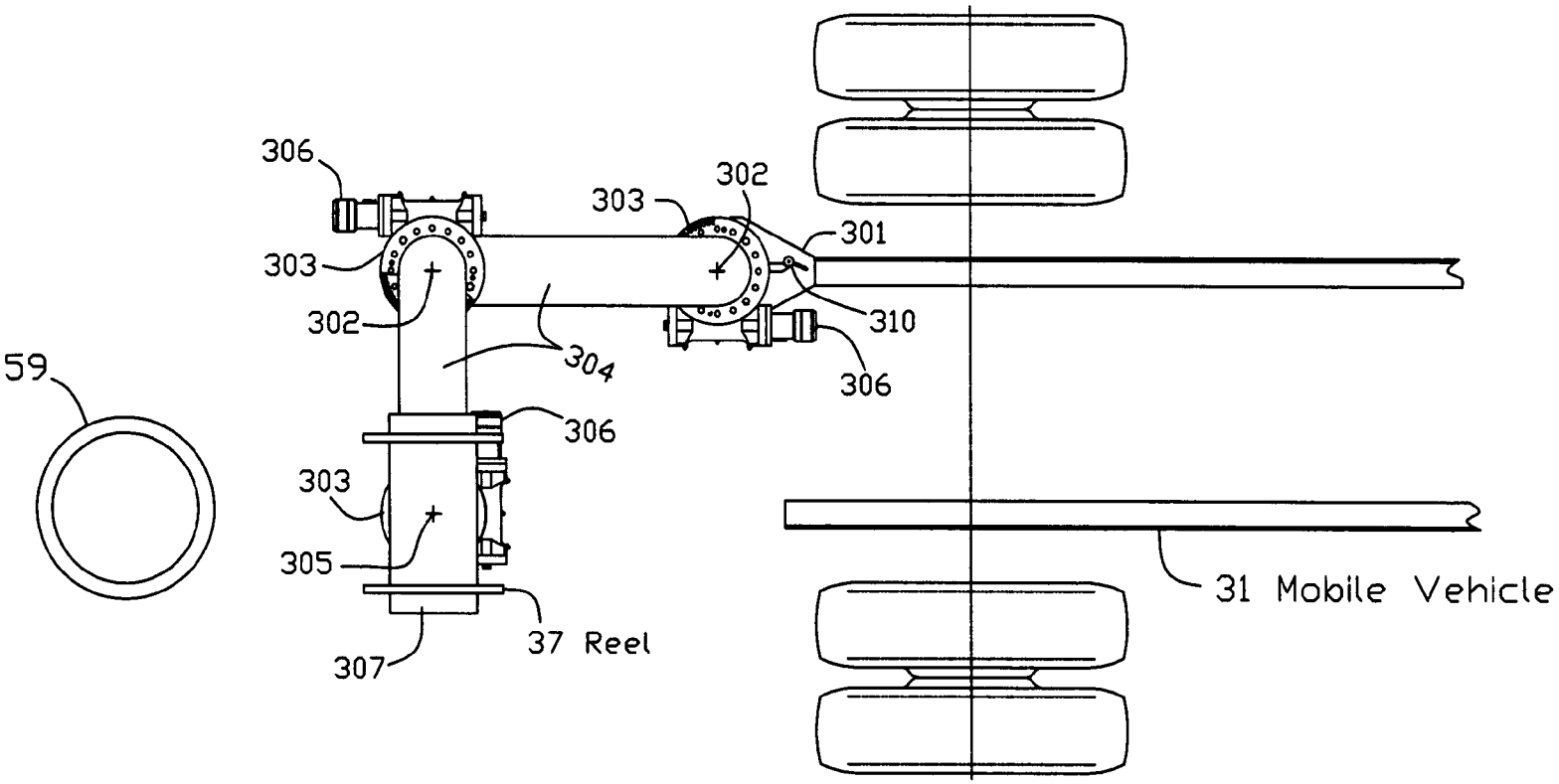

FIG. 4 illustrates the present invention's use of multiple boor arms 304 and multiple pivot able mounting means 302 in order to give additional articulation to the positioning of reel 37 in relation to a work area, man hole or the like.

Figure 5:
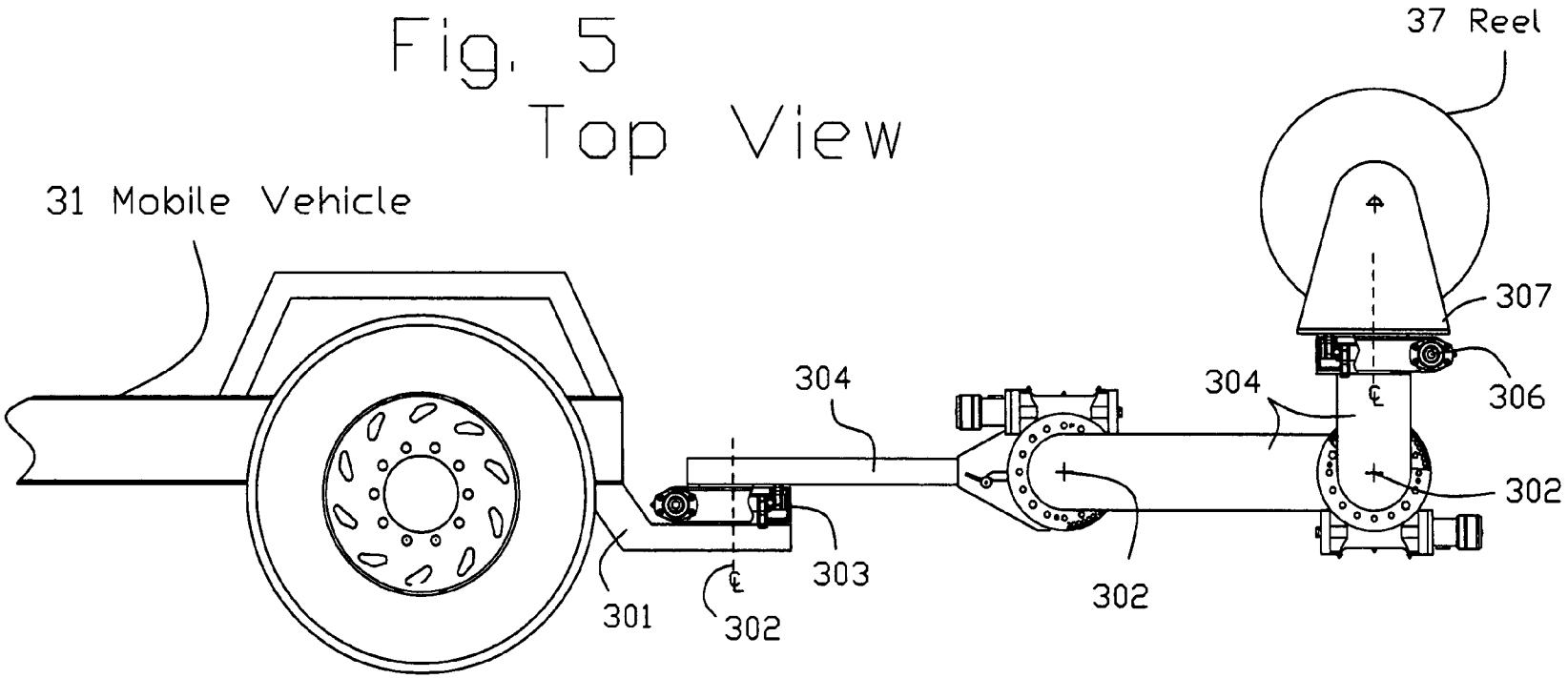
FIG. 5 is a side view of the concept shown by the plan view of FIG. 4.

FIG. 5 illustrates the present invention's use of multiple boom arms 304 and multiple mounting means 302 being oriented in both a horizontal and a vertical position in order to give even more articulation to the positioning of reel 37 in relation to a work area, man hole or the like.

Figure 6:
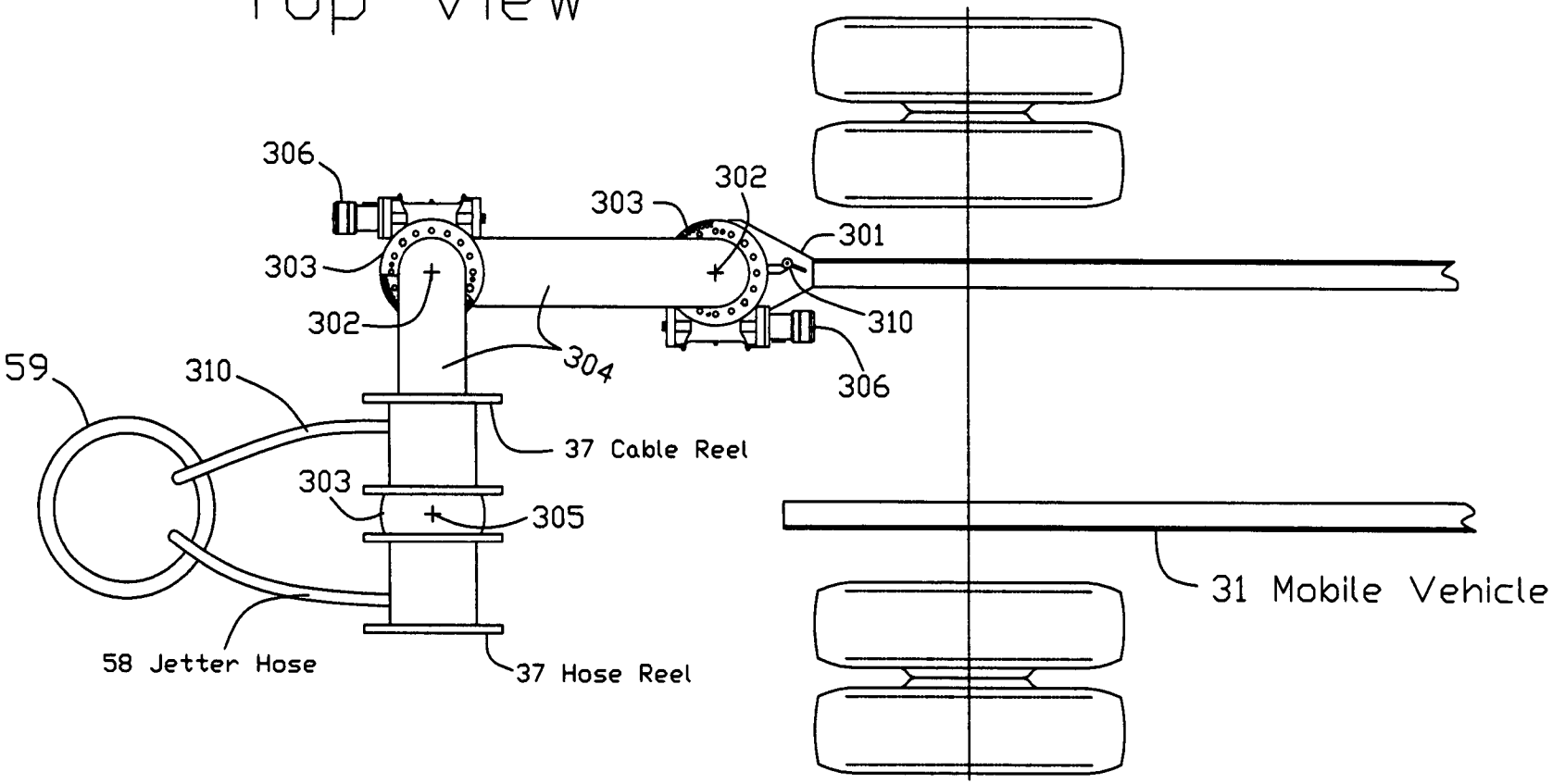
FIG. 6 is a top view similar to FIG. 4.

FIG. 6 illustrates the present invention's use of two or more reels 37 placed simultaneously near a man hole, work area, or the like. Each reel 37 may have a different function. For example, one reel 37 may use a jetter hose 58 to clean a clog of earthen material 45 from a drain pipe 38 and a second reel 37 may have a fiber optic cable 310 to power and get pictures from a camera 325 which documents the condition of drain pipe 38.

As illustrated in FIGS. 7, 8 & 9, boom 300 has an out rigger 320 adding additional support and stability to the second end of boom arm 300. Outrigger 320 is illustrated to have a foot 322 attached. The outrigger 320 could be in the form of a stiff leg, a tripod, a powered side arm similar in function to that of a back hoe or crane, or the like. The foot 322 is a base used to grip and or support out rigger 320 against a firm foundation. A guide 321 is illustrated as a means to protect or align the likes of a cable 328 or jetter hose 58 while entering or exiting a man hole. The outrigger 320 may also have an attached, extension to support a guide roller 323. Guide roller 323 assist to stabilize the likes of a cable 328 or jetter hose 58 while entering or exiting a man hole lateral line.

FIG. 7 illustrates the present invention using a boom 300 to support a reel 37. FIG. 7 illustrates yet another use for the reel 37. In FIG. 7, reel 37 is illustrated as being used as a wench to pull a wedge 324 through a lateral line 38 using a cable 328.

FIG. 7 is yet another aspect of the present invention. For example: FIG. 1 illustrates the present invention jettering 39 debris 45 from a drainage pipe 38. In some cases it is efficient to also attach a cable 328 along side the jetter hose 58 and use the jetter nozzle 39 for cleaning a hole through the clogging dirt 45 while simultaneously pulling a length of attached cable 328 through the pierced clearance hole in the clog 45. After a second end of the cable 328 has been pulled through a hole in the clog 45, a wedge 324 attached to the second end of the cable 328 can be pulled back thought the clog 45. Reel 37 serves as a winch by rolling up a first end of the cable 328.

The wedge 324 could be attached to the second end of cable 328 at a second man hole 59 upstream from the clog 45, or the wedge 324 could be of a collapsible design which collapses or flattens when being pulled by the jetter nozzle 39 and expands into an enlarged wedge when pulled in the reverse direction by a second end of a jetter hose 58 or a cable 328 which may also be an umbilical cord which is defined for the purpose of this patent as a combination of two or more types of flex able elongated objects working together for a common purpose such as a jetter hose 58 combined with a cable. When the wedge 324 is being pulled by a second end of cable 328 through a clog 45 in a drain pipe 38, the wedge 324 may also have jetter nozzles 39 spraying water 2. Placing the jetter nozzle 39 on the wedge 423 also places the pressurized water 2 closer to the wall of a sewer or drainage pipe 38, thus the pressure of the water 2 impinging the inside wall of the pipe 38 is greater thus, larger pipes 38 can be cleaned with lesser volumes of water 2 and at lower pressures. The wedge 324 can be expanded or collapsed using a fluid like water 2 or air or mechanically using a hinge arrangement.

Figure 7B:
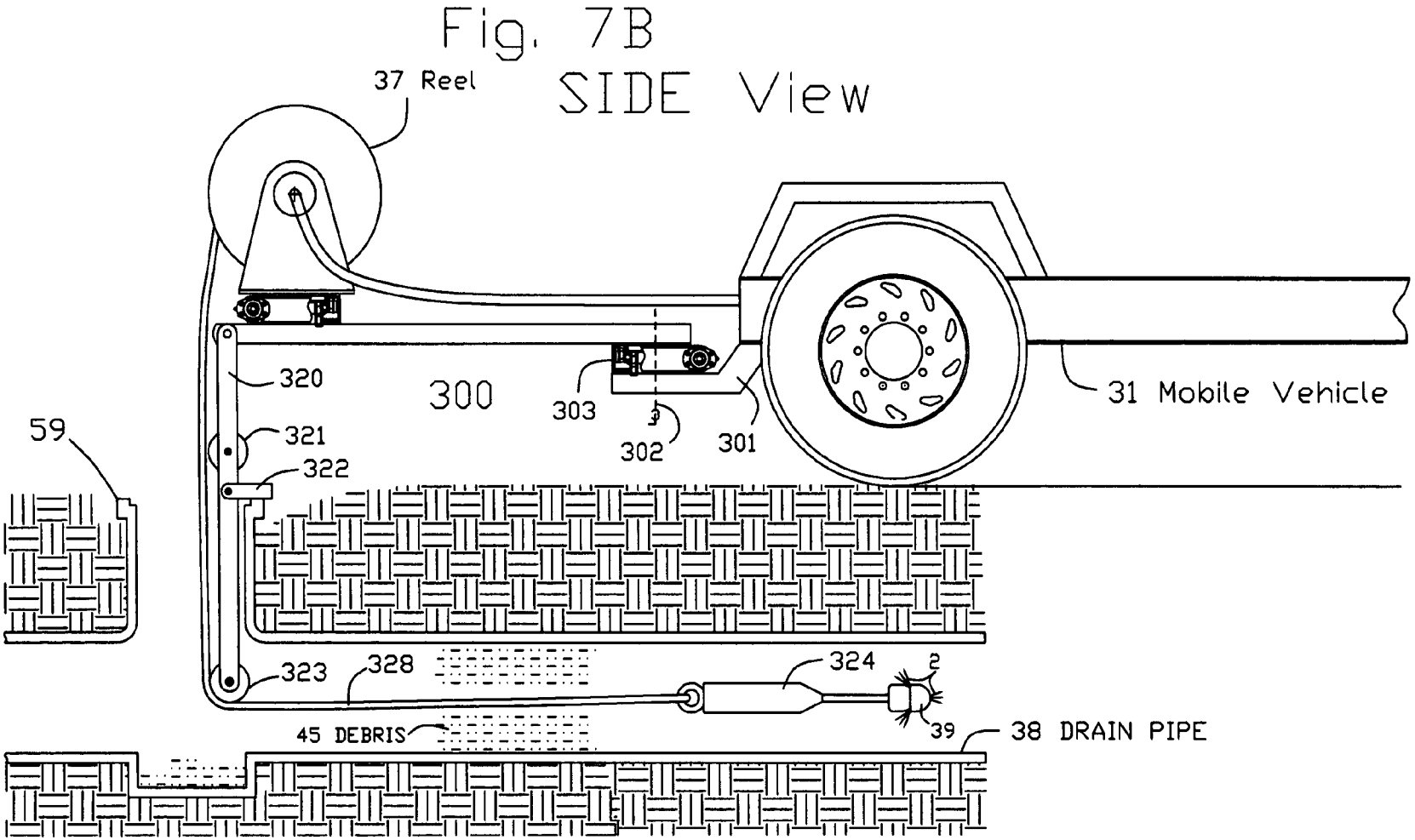
FIG. 7B is an illustration of a wedge which is used to clean clogged sewer lines or drainage pipes. When it is pulled by a jetter it is collapsed and flattened but when it is pulled by a second end of a cable it is expanded into a wedge.

FIG. 7B illustrates the wedge 324 in a collapsed and flattened configuration as it is being pulled by a jetter nozzle 39.

FIG. 8 illustrates reel 37 supplying a power, electronic and fiber optic cord 310 having a camera 325 attached and moved through a pipe 38 to observe the condition of the pipe 38. In this example the camera 325 has the ability to pictures of the conditions and to take digital measurements of repair areas 327. Camera 325 can be a digital camera, a video camera, a CMOS camera, a CCD camera that use time of flight principals to measure the size and position of items or the like. Wave lengths 326 are used in monitoring the condition of a repair area 327. Data from sending and receiving wave lengths 326 is transmitted back to data loggers and computers for analysis, and use to prepare for a next phase of the service work.

FIG. 9 illustrates reel 37 having the first end of cable 330 attached to reel 37 and a second end of cable 330 attached to an inflatable base 401 and said cable 330 is a multi functional umbilical cord having ability to supply air, power, electronic, air craft cable and fiber optics to an inflatable base 401, having a first end of an articulated robotic arm 402 attached to the inflatable base 401. A second end of the articulated robotic arm 402 is illustrated as having an attachment means to support surface preparation tools 403. A surface preparation tool 403 can be chosen from an abrasive disc, a sand blaster, a water/sand blaster, a laser, a hand, a heat gun, or the like. The articulated robotic arm 402 may be powered and remotely operated. The arm 402 is used in conjunction with the inflatable base 401 and the tool attachment means 403 in order to fix a repair area 327. 404 represents water, sand, air or heat being directed toward repair area 327 in order to repair a damaged pipe 38. The inflatable base 401 becomes stable when inflated against the wall of a pipe 38. Inflatable base 401 is also shown to serve as a mounting platform for a camera 325. The camera 325 is able to be remotely controlled in order to visualize the work area 327.

The preceding description has been presented only to illustrate and describe an example of the invention. It is not intended to be exhaustive or to limit the invention to any precise form disclosed. Many modifications and variations are possible in light of the above teaching.

The illustrations were chosen and described in order to explain the principles of the invention and its practical application. The preceding description is intended to enable others skilled in the art to utilize the invention in various embodiments and with various modifications as are suited to the particular use contemplated. It is intended that the scope of the invention be defined by the following claims.

The invention claimed is:

1. A mobile apparatus for servicing or cleaning a utility sewer pipe or drainage pipe comprising: a mobile platform wherein said mobile platform further comprises; a vacuum container; a vacuum producing means for producing a vacuum environment within said vacuum container; a vacuum hose for conveying solids or liquid into said vacuum container; a pump for pressurizing water; a hose for conveying said pressurized water to a jetter nozzle; a reel comprising at least one reel member, wherein said reel dispenses and retracts a length of said hose, and said reel is supported by a boom arm and said reel is pivotably mounted via a first slewing ring gear to said boom arm and said boom arm is pivotably mounted on said mobile platform via a second slewing ring gear.

2. An apparatus according to claim 1 wherein said mobile platform further comprises a vacuum hose reel for retracting or dispensing a length of said vacuum hose and said vacuum hose reel is pivotably mounted adjacent said mobile platform via a slewing ring gear and said slewing ring gear is rotated via a motor.

3. An apparatus according to claim 1 and further comprising a controller for controlling at least one parameter and determining at least one condition relative to said apparatus of claim 1.

4. An apparatus according to claim 1 and further comprising a cable; and further comprising a cable reel which comprises at least one reel member; wherein said cable reel dispenses and retracts a length of said cable; and further comprising a wedge wherein said wedge is attached to an end of said cable for the purpose of said wedge being pulled through said utility sewer pipe or drainage pipe by said cable.

5. A mobile apparatus for servicing or cleaning a utility sewer pipe or drainage pipe comprising: a mobile platform wherein said mobile platform further comprises; a pump for pressurizing water; a hose which conveys said pressurized water to a jetter nozzle; a reel comprising at least one reel member; wherein said reel dispenses and retracts a length of said hose; a boom arm wherein said reel is supported by said boom arm and said reel is pivotably mounted about a first axis via a first slewing ring gear to said boom arm and said boom arm is pivotably mounted about a second axis adjacent to said mobile platform via a second slewing ring gear, wherein the first and second axes are substantially parallel.

6. An apparatus according to claim 5 wherein said slewing ring gear further comprises a power means for accomplishing a rotation of said slewing ring gear.

7. An apparatus according to claim 5 and further comprising a measuring apparatus for measuring and determining at least one condition relative to said reel.

8. An apparatus according to claim 5 and further comprising a sensor for measuring at least one parameter and determining at least one condition relative to said servicing or cleaning of a utility sewer or drainage pipe and said sensor being selected from a sensor group consisting of, an RFID, a torque sensor, a rotation sensor, a distance measuring apparatus, a pressure sensor, a GPS sensor, a flow sensor, and an image sensor.

9. An apparatus according to claim 5 and further comprising a cable; and further comprising a cable reel and said cable reel comprising at least one reel member, wherein said cable reel dispenses and retracts a length of said cable; whereby said cable reel may be mounted on said boom.

10. An apparatus according to claim 5 and further comprising an umbilical cord; and further comprising an umbilical cord reel and said umbilical cord reel further comprising at least one reel member, wherein said umbilical cord reel dispenses and retracts a length of said umbilical cord; whereby said umbilical cord reel may be mounted on said boom.

11. An apparatus according to claim 5 wherein said boom arm further comprises an out rigger.

12. An apparatus according to claim 5 and further comprising an umbilical cord; and further comprising an umbilical cord reel, wherein said umbilical cord reel further comprises at least one reel member, wherein said umbilical cord reel dispenses and retracts a length of said umbilical cord; wherein said umbilical cord may be selected from the group consisting of a cable, an air hose, a water hose, a hydraulic hose, a fiber optic cable, and an electrical cord.

13. An apparatus according to claim 5 and said mobile platform further comprising; an umbilical cord; an umbilical cord reel which comprises at least one reel member, wherein said umbilical cord reel dispenses and retracts a length of said umbilical cord; an articulated robotic arm wherein said articulated robotic arm further comprises an attachment means for attaching tools; and further comprising an inflatable base, wherein said articulated robotic arm and said inflatable base are positioned in communication with each other and said umbilical cord; whereby said umbilical cord may position said inflatable base into a predetermined position within said drainage pipe and supply utilities to said inflatable base and said articulated robotic arm, whereby said inflatable base is expanded and attached to the side walls of said drainage pipe and power is supplied to the articulated robotic arm.

14. An apparatus according to claim 5 and further comprising an expandable base for attaching to the side walls of said drainage pipe or said sewer pipe; and further comprising an articulated robotic arm having a first end and a second end wherein said first end of said articulated robotic arm is attached to said expandable base and said second end of said articulated robotic arm further comprises a tool attachment apparatus.

15. An apparatus according to claim 5 and further comprising an expandable base for attaching to the side walls of said drainage pipe or said sewer pipe; and further comprising an articulated robotic arm having a first end and a second end wherein said first end of said articulated robotic arm is attached to said expandable base and said second end of said articulated robotic arm further comprises a tool attachment apparatus; and further comprising a surface preparation tool selected from the group consisting of a light, a camera, a drill, a grinder, an abrasive disc, an air sand blaster, a water sand blaster, a laser, a hand, and a heat gun; wherein said jetter hose, said expandable base and said robotic arm work in communication with each other; whereby a damaged section of said drainage pipe or said sewer pipe may be serviced or repaired.

16. An apparatus according to claim 5 and further comprising a remote control which controls at least one function of said apparatus.

17. An apparatus according to claim 5 and further comprising an expandable base for attaching to the side walls of said drainage pipe or said sewer pipe; and further comprising an articulated robotic arm having a first end and a second end wherein said first end of said articulated robotic arm is attached to said expandable base and said second end of said articulated robotic arm further comprises a tool attachment apparatus; and further comprising a remote control which controls at least one function of said articulated robotic arm.

18. An apparatus according to claim 5 and further comprising an RFID means for identifying information which is relative to a utility service event; wherein said RFID means further comprises an RFID tag positioned in proximity to a utility access; whereby an RFID reader adjacently positioned on said mobile platform may read stored information respective to a service event and said RFID tag contains a code specific to said RFID tag and said RFID reader which is associated with said code with said stored information when activated by a signal between said RFID tag and said RFID reader; whereby information pertaining to a service event may be retrieved by positioning said RFID tag in proximity to said RFID reader.

19. A mobile apparatus for servicing or cleaning a utility sewer pipe or drainage pipe comprising: a mobile platform; and said mobile platform comprising; a vacuum hose which conveys solids or liquids into a vacuum container, a first reel which dispenses and retracts a length of said vacuum hose, a first boom arm which supports said vacuum hose and said first boom arm is pivotable; a pump which pressurizes water; a jetter hose which conveys said pressured water to a jetter nozzle, a second reel comprising at least one reel member; wherein said second reel dispenses and retracts a length of said jetter hose, and said second reel is supported by a second boom arm; wherein said second reel is pivotably mounted via a first slewing ring gear to said second boom arm and said second boom arm is pivotably mounted via a second slewing ring gear to said mobile platform.

* * * * *